US005773736A

United States Patent [19]

Hsieh

[11] Patent Number: 5,773,736

[45] Date of Patent: Jun. 30, 1998

[54] ADJUSTING DEVICE FOR A DRUMSTICK FRAME

[76] Inventor: Wu-Hong Hsieh, No. 46, Lane 59, Chungcheng Rd., Luchou Hsiang, Taipei Hsien, Taiwan

[21] Appl. No.: 901,046

[22] Filed: Jul. 28, 1997

[51] Int. Cl.[6] ..... G10D 13/02

[52] U.S. Cl. ..... 84/422.1

[58] Field of Search ..... 84/422.1, 422.2, 84/422.3, 422.4

[56] References Cited

U.S. PATENT DOCUMENTS

| | | | |
|---|---|---|---|
| 5,365,824 | 11/1994 | Hoshino | 84/422.1 |
| 5,379,674 | 1/1995 | Hoshino | 84/422.1 |
| 5,398,584 | 3/1995 | Liao | 84/422.1 |

*Primary Examiner*—Stanley J. Witkowski

*Attorney, Agent, or Firm*—Hedman, Gibson & Costigan, P.C.

[57] ABSTRACT

An improved adjusting device for a drumstick frame is disclosed. The drumstick frame has two side rods, a pivot disposed between the two side rods, and a pedestal mounted on the pivot to connect a drum pedal with a drumstick. The adjusting device is mounted on one of the side rods and connected with the pivot for adjusting the operation of the drumstick. The adjusting device includes a spring connected to the pivot, a screw rod connected with the spring, and a rating nut and a fixing nut received on the screw rod. The rating nut defines a circumferential recess therein. The circumferential recess further defines at least one cavity therein for receiving a steel ball. The adjusting device further includes an elastic element disposed in the side rod. The steel ball is retained between the elastic element and the circumferential recess of the rating nut.

2 Claims, 4 Drawing Sheets

ADJUSTING DEVICE FOR A DRUMSTICK FRAME

BACKGROUND OF THE INVENTION

1. Field of the Invention

The present invention relates to a device for adjusting a drumstick frame, and more particularly to an improved adjusting device for a drumstick frame, which can effectively locate an original position of a rating nut thereof in order to control a return speed of the drumstick.

2. Description of Related Art

Drums have been popular musical instruments for thousands of years all over the world, and the bass drum has become particularly popular in modern music. In order to be beaten, the bass drum generally has a drumstick frame 50, as shown in FIG. 4. The drumstick frame 50 includes two side rods (not numbered) and a pivot 51 connected between the two side rods. A pedestal 52 is mounted on the pivot 51 to connect a drum pedal (not numbered) to a drumstick 60. A clip 53 is mounted on an extended end of the pivot 51 to connect with an adjusting device (not numbered). The adjusting device is mounted to one of the side rods and includes a spring 54 connected with the clip 53, a screw rod 57 connected with the spring 54, a rating nut 56 and a fixing nut 55. The screw rod 57 subsequently extends through the fixing nut 55, a first protrusion 58 formed on the side rod, the rating nut 56, and a second protrusion 59 formed on the side rod. With this arrangement, the adjusting device can adjust a return speed of the drumstick 60 by means of modifying the tightness of the spring 54 by adjusting the rating nut 56. This kind of adjusting device has a disadvantage because the fixing nut 55 may become loose, or even lost, after an extended period of time due to vibration caused by repeated beatings the drum. As a result, the original position of the rating nut 56 can not be located after adjustment which will interfere with the desired return speed of the drumstick.

The present invention provides an improved adjusting device for a drumstick frame to mitigate and/or obviate the aforementioned problems.

SUMMARY OF THE INVENTION

One object of the present invention is to provide an adjusting device for a drumstick frame , which can effectively locates an original position of a rating nut thereof in order to control a return speed of the drumstick.

In accordance with one aspect of the present invention, the drumstick frame has two side rods, a pivot disposed between the two side rods, and a pedestal mounted on the pivot to connect a drum pedal with a drumstick. An adjusting device is mounted on one of the side rods and connected with the pivot for adjusting the operation of the drumstick. The adjusting device includes a spring connected to the pivot, a screw rod connected with the spring, and a rating nut and a fixing nut each received on the screw rod. The rating nut defines a circumferential recess therein. The circumferential recess further defines at least one cavity therein for receiving a steel ball. The adjusting device further includes an elastic element disposed in the side rod. The steel ball is retained between the elastic element and the circumferential recess of the rating nut.

In accordance with another aspect of the present invention, the elastic element is a compression spring.

Other objects, advantages and novel features of the invention will become more apparent from the following detailed description when taken in conjunction with the accompanying drawings.

DETAILED DESCRIPTION OF PREFERRED EMBODIMENT

Figure 1:
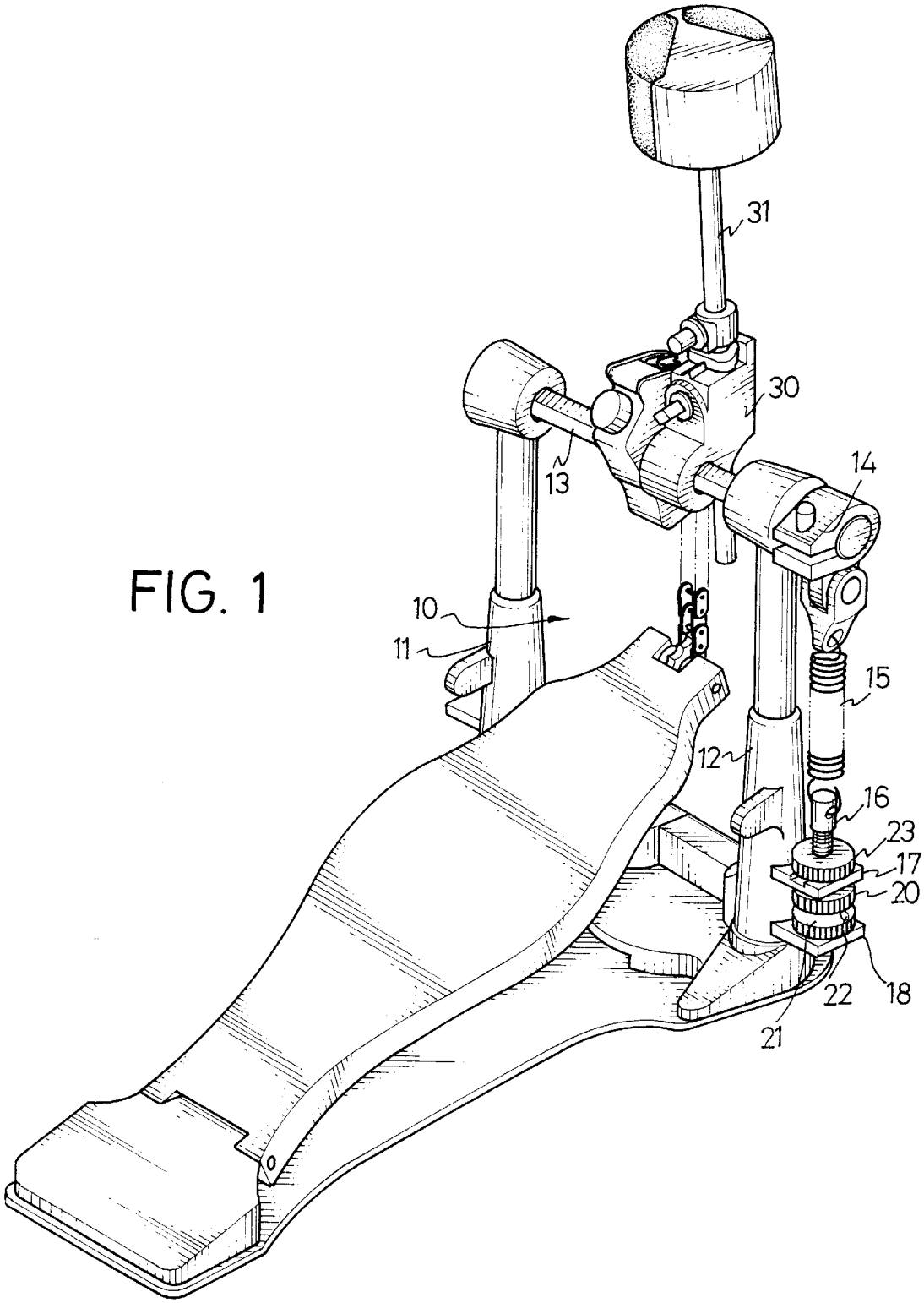
FIG. 1 is a perspective view showing a drumstick frame in accordance with the present invention.

Referring to FIG. 1, a drumstick frame 10 in accordance with the present invention generally includes a first side rod 11 and a second side rod 12 respectively disposed at two sides of a drum pedal (not numbered) and a pivot 13 connected between the first and second side rods 11, 12, wherein one end of the pivot 13 extends outwardly from the second side rod 12. A pedestal 30 is mounted on the pivot 13 to connect the pedal to a drumstick 31. A clip 14 is mounted on the extended end of the pivot 13 to connect with an adjusting device (not numbered).

Figure 2:
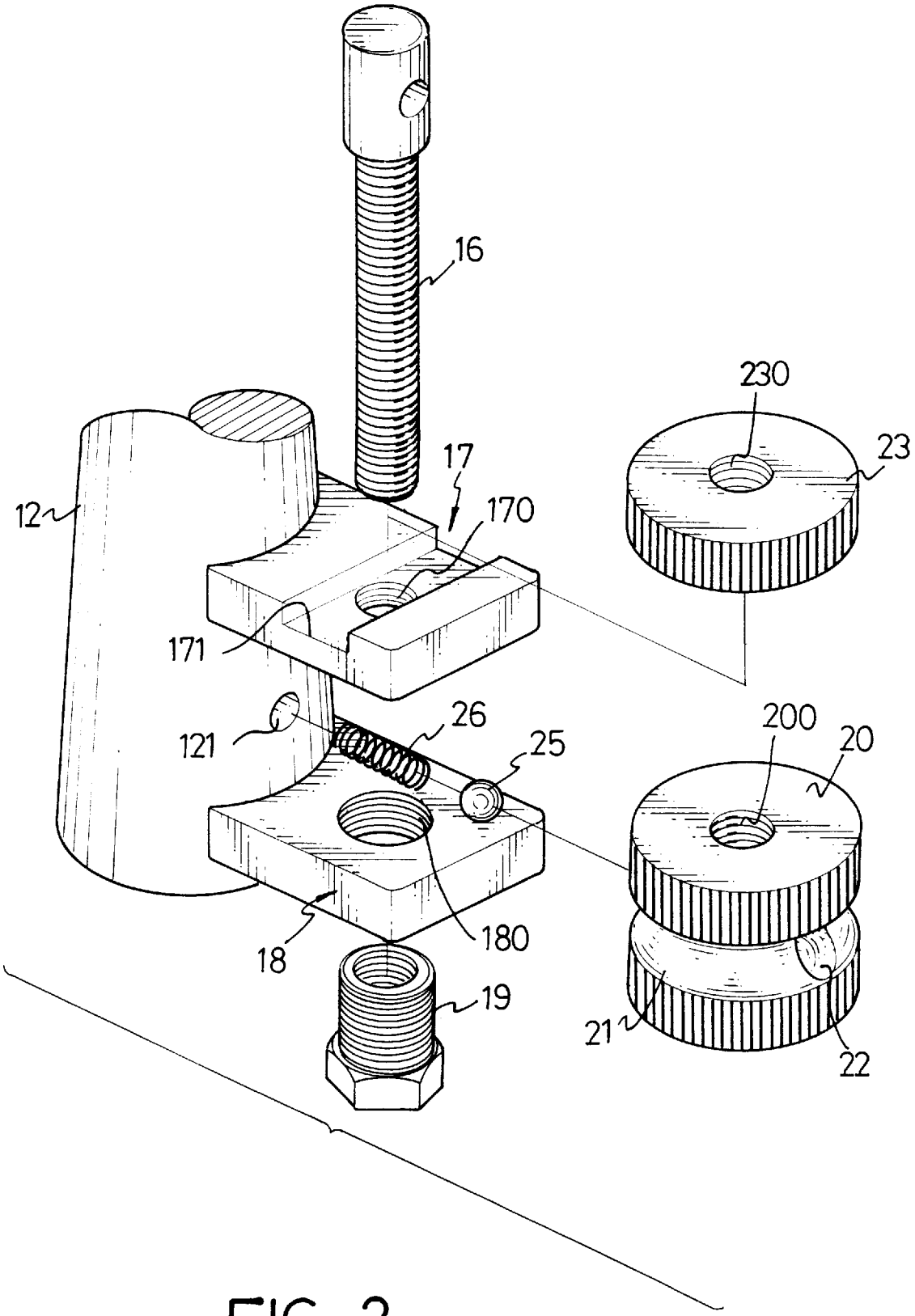
FIG. 2 is a partial exploded view showing an adjusting device for the drumstick frame in accordance with the present invention.

Referring to FIG. 2, the side rod 12 defines a blind hole 121 in a circumference thereof and has a first protrusion 17 and a second protrusion 18 integrally extending from the circumference. The first protrusion 17 defines a recess 171 therein and a first hole 170 with female thread in the recess 171. The second protrusion 18 defines a second hole 180 with female thread. The adjusting device includes a spring 15 connected with the clip 14 (see FIG. 1), a screw rod 16 connected with the spring 15, a rating nut 20 and a fixing nut 23. The rating nut 20 and the fixing nut 23 define a first screw hole 200 and a second screw hole 230, respectively. In assembly, a bolt 19 with male and female thread is firstly engaged with the second hole 180 of the second protrusion 18. Then the screw rod 16 is subsequently screwed in the second screw hole 230 of the fixing nut 23, the first hole 170 of the first protrusion 17, the first screw hole 200 of the rating nut 20, and threadedly engaged with the bolt 19. Since the bolt 19 is pre-engaged with the second protrusion 18, a stretching force of the screw rod 16 to the bolt 19 can be reduced. Therefore, a loose possibility of the screw rod 16 and the bolt 19 will be avoid. With this arrangement, the adjusting device can adjust a return speed of the drumstick 31 by means of modifying tightness of the spring 15 by adjusting the rating nut 20.

In the present invention, the rating nut 20 further defines a circumferential recess 21 therein. The circumferential recess 21 defines at least one cavity 22 (In this embodiment, there are two cavities.) therein configured to receive a steel ball 25. The adjusting means further has an elastic element 26, which can be a compression spring, disposed in the blind hole 121 of the side rod 12. The steel ball 25 is retained between the elastic element 26 and the circumferential recess 21 of the rating nut 20.

Figure 3:
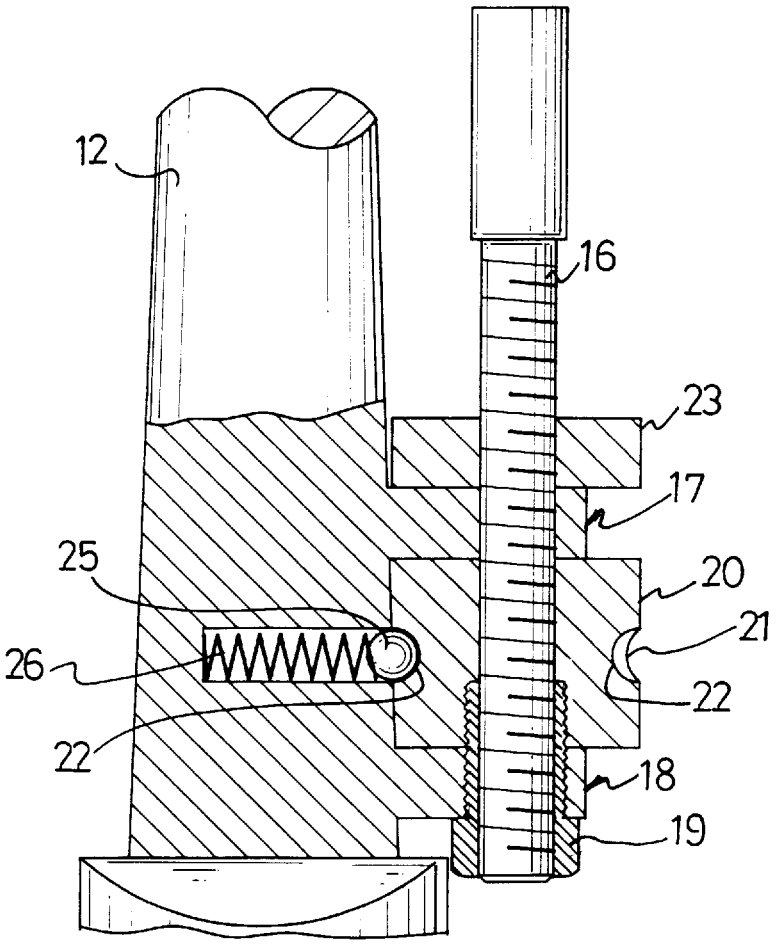
FIG. 3 is a cross sectional view showing a combined structure of the adjusting device and a side rod of the drumstick frame.
Figure 4:
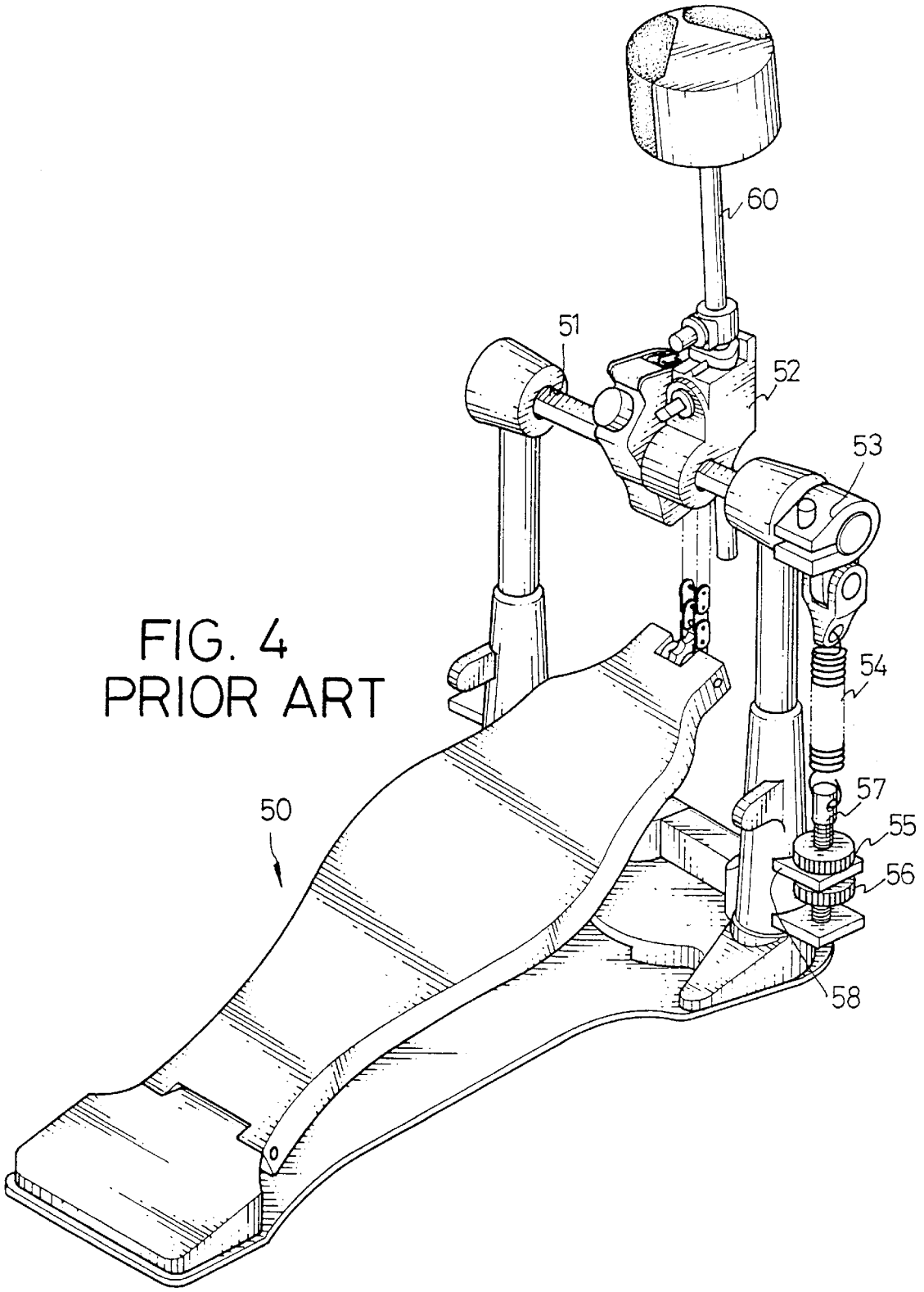
FIG. 4 PRIOR ART
FIG. 4 is a perspective view showing a conventional drumstick frame of a drum.

A combined structure of the adjusting device and the side rod 12 is shown in FIG. 3. When the rating nut 20 is rotated for adjustment, a periphery of the circumferential recess 21 will move with respect to the steel ball 25 and slightly extrude the steel ball 25. When the cavity 22 aligns with the steel ball 25, the steel ball 25 will be urged by the elastic element 26 and received in the cavity 22. In this way, even if the fixing nut 23 becomes loose after an extended period of time due to vibration, the original position of the rating nut 20 can be located by the steel ball 25 and the cavity 22. Therefore, a change in the tightness of the spring 15 can be prevented and it is easy for a user to control the return speed of the drumstick.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An improved adjusting device for a drumstick frame, said drumstick frame having two side rods, a pivot disposed between the two side rods, a pedestal mounted on the pivot to connect a drum pedal with a drumstick, said adjusting device being mounted on one of the side rods and connected with said pivot for adjusting the operation of the drumstick, said adjusting device comprising:

a spring connected to the pivot;

a screw rod connected with the spring;

a rating nut and a fixing nut received on the screw rod, said rating nut defining a circumferential recess therein, said circumferential recess further defining at least one cavity therein for receiving a steel ball;

an elastic element disposed in said side rod; and the steel ball retained between the elastic element and the circumferential recess of the rating nut.

2. An adjusting device for a drumstick frame as claimed in claim 1, wherein said elastic element is a compression spring.

* * * * *